US011191318B2

(12) United States Patent
Biancucci et al.

(10) Patent No.: US 11,191,318 B2
(45) Date of Patent: Dec. 7, 2021

(54) SOLE PROVIDED WITH OVERTURNING ANTI-SLIPPING MEANS

(71) Applicant: AL.PI. S.R.L., Civitanova Marche (IT)

(72) Inventors: Demetrio Biancucci, Civitanova Marche (IT); Alfredo Brasca, Civitanova Marche (IT)

(73) Assignee: AL.PI. SRL, Morrovalle (IT)

( * ) Notice: Subject to any disclaimer, the term of this patent is extended or adjusted under 35 U.S.C. 154(b) by 219 days.

(21) Appl. No.: 16/481,838

(22) PCT Filed: Mar. 2, 2018

(86) PCT No.: PCT/IB2018/051334
§ 371 (c)(1),
(2) Date: Jul. 30, 2019

(87) PCT Pub. No.: WO2018/158736
PCT Pub. Date: Sep. 7, 2018

(65) Prior Publication Data

US 2019/0373983 A1 Dec. 12, 2019

(30) Foreign Application Priority Data

Mar. 3, 2017 (IT) ..... 102017000024298

(51) Int. Cl.
*A43B 13/26* (2006.01)
*A43C 15/02* (2006.01)
(Continued)

(52) U.S. Cl.
CPC ..... *A43B 13/26* (2013.01); *A43C 15/02* (2013.01); *A43C 15/005* (2013.01); *A43C 15/04* (2013.01); *A43C 15/08* (2013.01); *A43C 15/161* (2013.01)

(58) Field of Classification Search
CPC ..... A43C 15/02; A43C 15/005; A43C 15/04; A43C 15/08; A43C 15/161; A43B 13/26
See application file for complete search history.

(56) References Cited

U.S. PATENT DOCUMENTS 286,240 A * 10/1883 Treat ..... A43C 15/08 36/59 R
4,262,434 A 4/1981 Michelotti
(Continued)

FOREIGN PATENT DOCUMENTS

CN 201709486 U 1/2011
CN 202919160 U 5/2013
(Continued)

OTHER PUBLICATIONS

International Search Report—PCT/IB2018/051334—dated Jun. 8, 2018.

*Primary Examiner* — Jila M Mohandesi
(74) *Attorney, Agent, or Firm* — Nixon & Vanderhye

(57) ABSTRACT

In an anti-slipping device for a shoe sole having an anti-slipping or anti-sliding component such as nails or spikes which are not secured to the sole but are secured on support elements which can be overturned to be hidden in slots made on the sole itself, each overturning support element is hinged at its ends on cubic blocks which are anchored to the sole due to a mushroom-shaped coupling element which is molded in once piece to the cubic block itself, made of the same thermo-polyurethane material as the support elements and which is snap-fitted in its seat arranged in the sole next to the slot where the overturning support element is accommodated after the overturning, without interfering with the integrity of the sole itself and thus allowing the replacement thereof without difficulty. Also included is a mechanism for avoiding the accidental loss of the support element when walking.

21 Claims, 7 Drawing Sheets

(51) Int. Cl.

| | |
|---|---|
| *A43C 15/00* | (2006.01) |
| *A43C 15/04* | (2006.01) |
| *A43C 15/08* | (2006.01) |
| *A43C 15/16* | (2006.01) |

(56) References Cited

U.S. PATENT DOCUMENTS

| | | | | |
|---|---|---|---|---|
| 6,385,865 | B1 * | 5/2002 | Jang | A43B 5/002 36/124 |
| 6,675,504 | B1 * | 1/2004 | Biancucci | A43C 15/08 36/59 R |
| 7,836,610 | B2 * | 11/2010 | Laporte | A43C 15/08 36/62 |
| 8,256,144 | B2 * | 9/2012 | Comoli | A43C 15/08 36/59 R |
| 2004/0035024 | A1 * | 2/2004 | Kao | A43C 15/14 36/61 |
| 2006/0162188 | A1 * | 7/2006 | Biancucci | A43C 15/08 36/61 |

FOREIGN PATENT DOCUMENTS

| | | |
|---|---|---|
| CN | 103211347 | 7/2013 |
| EP | 1096867 | 5/2001 |
| WO | 00/04803 | 2/2000 |

* cited by examiner

SEZ. X–X

SEZ. Y–Y

SEZ. Z-Z

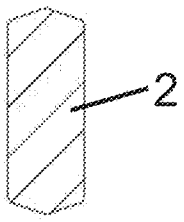
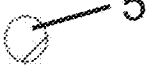
SEC. B-B
FIG. 8b
FIG. 8c
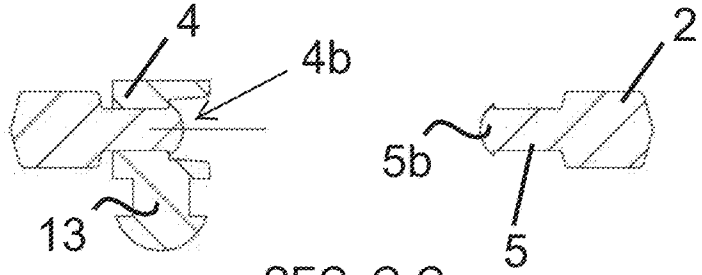
SEC. C-C
FIG. 8
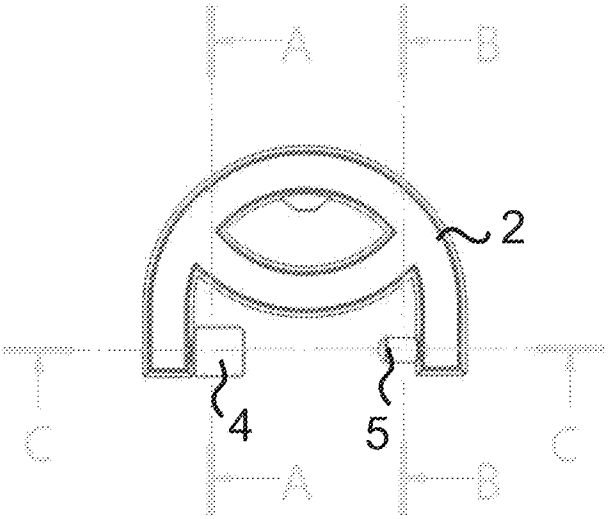
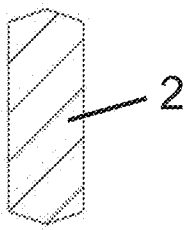
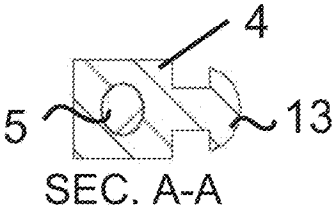
SEC. A-A
FIG. 8a

SOLE PROVIDED WITH OVERTURNING ANTI-SLIPPING MEANS

BACKGROUND OF THE INVENTION

Field of the Invention

The present invention relates to a shoe sole provided with an anti-slipping device of the type in which anti-slipping or anti-sliding means such as nails or spikes are provided, which are not directly secured to the sole but are secured on rigid or semirigid means which can be overturned to be hidden in slots obtained on the sole itself.

Description of the Related Art

More specifically, the invention relates to an improvement related to anchoring the anti-slipping element to the sole, and specifically refers to the anti-slipping device made known in European Patent 1,096,867 to the same Applicant, which is an integral part of the present description. In such a patent, there is described a shoe sole provided with a certain number of rigid spikes or nails on the face thereof in contact with the ground, which spikes are not firmly secured to the sole, rather on the contacting face of the sole of rigid or semirigid overturning elements, preferably made of semi-rigid plastic material, which are capable of switching from a first slot or recess obtained on said sole to a second slot, again obtained on the sole itself, symmetrically mirroring the preceding one, where said spikes are housed in suitable cavities obtained at the bottom of the slots housing said rigid elements.

These support elements may be in the form of bars, rails or also in the form of a pattern, and the overturning thereof occurs about horizontal axes, i.e. parallel to the resting plane of the sole, by means of two pins, carried at the opposite ends thereof, which are snap-fitted in respective rotation seats consisting of rigid cubic blocks, each provided laterally with a corresponding hinging hole. The two cubic blocks made of rigid material, which are preferably metallic, in turn are rigidly and permanently secured to the sole, each by means of a pin inserted in a hole obtained perpendicular to the sole itself.

Manufacturing output has been massively using materials such as vulcanized rubber, microporous rubber, "biolabel" microporous rubber, bi-density polyurethane and generally thermoplastic materials, for the sole for several years.

Over time, it has been ascertained that in addition to resulting in the need to manually intervene on the sole to assemble both the cubic blocks forming the rotation seat and the overturning anti-slipping elements, the solution described in the above-mentioned European Patent 1,096,867 also compromises the impermeability and resistance to tearing of the sole itself, and this due both to the continuous contact of the metal cubic blocks with the inner walls of the slots obtained in the sole made of thermoplastic material, and because the presence of the hole locally reduces the vertical thickness of the sole itself, thus jeopardizing the integrity thereof.

A further disadvantage is associated with the fact that the possible replacement due to breaking, loss or abrasion due to the use of the overturning support element of the nails or spikes, is rather difficult, considering that there is a need to intervene on the sole, elastically forcing it, precisely at the most stressed rotation seats.

Again another disadvantage lies in the fact that with the sole of the mentioned European Patent 1,098,867, the support elements of the spikes or nails don't always perfectly retract into the slot that should house them when they overturn, rather under certain circumstances, following for example accidental movements, it occurs that also when walking, they may accidentally come out of the slot in which they are accommodated, in both cases disturbing the correct resting of the shoe on the ground with the danger of tripping and falling for the person wearing them.

BRIEF SUMMARY OF THE INVENTION

It is the task of the present invention to obviate all the drawbacks of the prior art mentioned here, by providing the anchoring of the sole of each cubic block forming the rotation seat of the pin of the overturning support element to occur due to a mushroom-shaped coupling element which is already secured, in the production step, to the cubic block itself and which is snap-fitted in its seat prepared in the sole obtained by molding, next to the slot where the overturning support element is accommodated after the overturning, without interfering with the integrity of the sole itself and thus allowing the replacement thereof without difficulty.

According to a preferred embodiment, such a mushroom-shaped element is obtained by molding in one piece with the related cubic block, made of the same thermo-polyurethane material as the support elements and thus having the same elastic modulus as the elastic modulus of the support elements, which material is resistant to the cold, corrosion, and in any case is simultaneously flexible and adaptable to the slot of the sole. In turn, since it is made of the same material, the overturning pin carried by the ends of the spike support element is perfectly inserted into the hinging seat obtained inside the cubic block, thus increasing the mutual compatibility. The elastic modulus of the material of the cubic blocks is less than the elastic modulus of the material of the sole.

Therefore, unlike the preceding solution, there is no longer a union of thermoplastic material with an iron block.

The advantages of such a solution are apparent and significant:

a) The support elements of the spikes are easy to replace with this new anchoring device in the case of loss, breaking and abrasion due to use, also by the user him/herself, without the need for particular tools, unlike the known device where the metal cubic block was permanently secured to the sole;

b) The production of the sole is industrially quicker and avoids production rejects, since the related seat in which the mushroom-shaped element of the anti-slipping element according to the present invention is snap-fitted, was already arranged in the molding step.

It is another task of the present invention to provide an improved device for anchoring the anti-slipping element to the sole, capable of resolving the following technical problems:

avoiding the overturning pin of the support element from accidentally coming out of the seat obtained in the cubic block;

avoiding the support element itself from equally accidentally coming out of the slot in which it is accommodated when walking; and facilitating the user in the overturning operation of the support element of the spikes or nails, thus preventing intermediate positions from being stably taken on, therefore forcing the direct switching from the retracted position to the extracted position thereof, and vice versa.

Such results are obtained by providing the following:

both the overturning pin of the support element of the spikes and the related seat in the cubic block acting as pivot for the rotation thereof have oval geometry which causes the switching from an extracted position of the nails to a retracted position thereof, or vice versa, without intermediate positions;

the head of the pin and the seat in the cubic block are configured so that once the pin is introduced in said seat, the rotation thereof is possible, but the release thereof is not, thus avoiding a possible accidental loss;

each support element of the spikes is blocked to the sole when it is in its operating position (regardless of the mushroom-shaped pins which anchor the cubic blocks acting as pivot for the rotation), also by a particular tooth carried by the overturning spike support element itself, which tooth is engaged in a snap-fitting manner in a specific concave seat obtained on the inner vertical wall of the slot of the sole created by undercut, which due to the geometry thereof, allows tightening when walking which is directly proportional to the bending exerted due to the effect of the movement.

Finally, to ensure that the support elements of the spikes perfectly return to the rest position, a protrusion (sphere-like) is provided which in the case of improper use—i.e. when the support elements of the spikes were not retracted accurately into rest position in the housing slots is capable of exerting a pressure on the elements themselves sufficient to sink them into the corresponding slot at the contact alone with the sole, without the need to use hands, which is unpleasant in the case of snow, ice and mud.

It is worth noting that said sphere-like protrusion does not touch the ground with the support elements of the spikes perfectly retracted in the housing slots in the rest position because it is in a raised position with respect to the ground due to the plugs obtained on the face of the sole in contact with the ground, and thus it does not interfere in any manner with the resting stability.

According to another feature of the invention, specific tapered slots facilitating the change of position, also manual change of position, are provided between the plugs of the sole in order to promote the overturning operation of the support elements of the spikes from the rest position to the operating one (anti-slipping).

BRIEF DESCRIPTION OF THE DRAWINGS

Further features and advantages of the invention will become apparent from the accompanying drawings which show a preferred embodiment thereof by way of non-limiting example.

In the drawings:

FIG. 8 shows a spike holder bracket like in FIGS. 4 and 5, which shows the horizontal overturning pin on one side and the cubic block forming the rotation seat thereof on the other;

FIGS. 8*a*, 8*b* and 8*c* are sectional views according to the layout plans A-A, B-B and C-C of FIG. 8, respectively, which show the cubic block with the mushroom-shaped coupling, the oval geometry of the horizontal overturning pin and the tapered head thereof;

DETAILED DESCRIPTION OF THE PREFERRED EMBODIMENTS

With reference to the figures, a shoe sole 1 is shown, made of moderately plugged synthetic material which allows good performance on almost all surfaces (tartan, asphalt, grass, sand, linoleum, etc.) but which loses its adherence features on dirt and muddy surfaces, and even more so on snowy or icy surfaces. Footwear made specifically for such a use is provided for such surfaces. The main features are found in a significantly sturdier structure which however is accompanied by an increased weight and a highly plugged sole, which allows an optimal grip on hard surfaces. However, such soles strongly affect the general appearance of the footwear whereby such a solution is limited to sports shoes or boots made specifically for this purpose.

According to the present invention, the anti-slipping sole 1 with spikes to be hidden according to the invention instead has a limited thickness which allows the use thereof in various types of footwear without the general appearance thereof being compromised.

Figure 1:
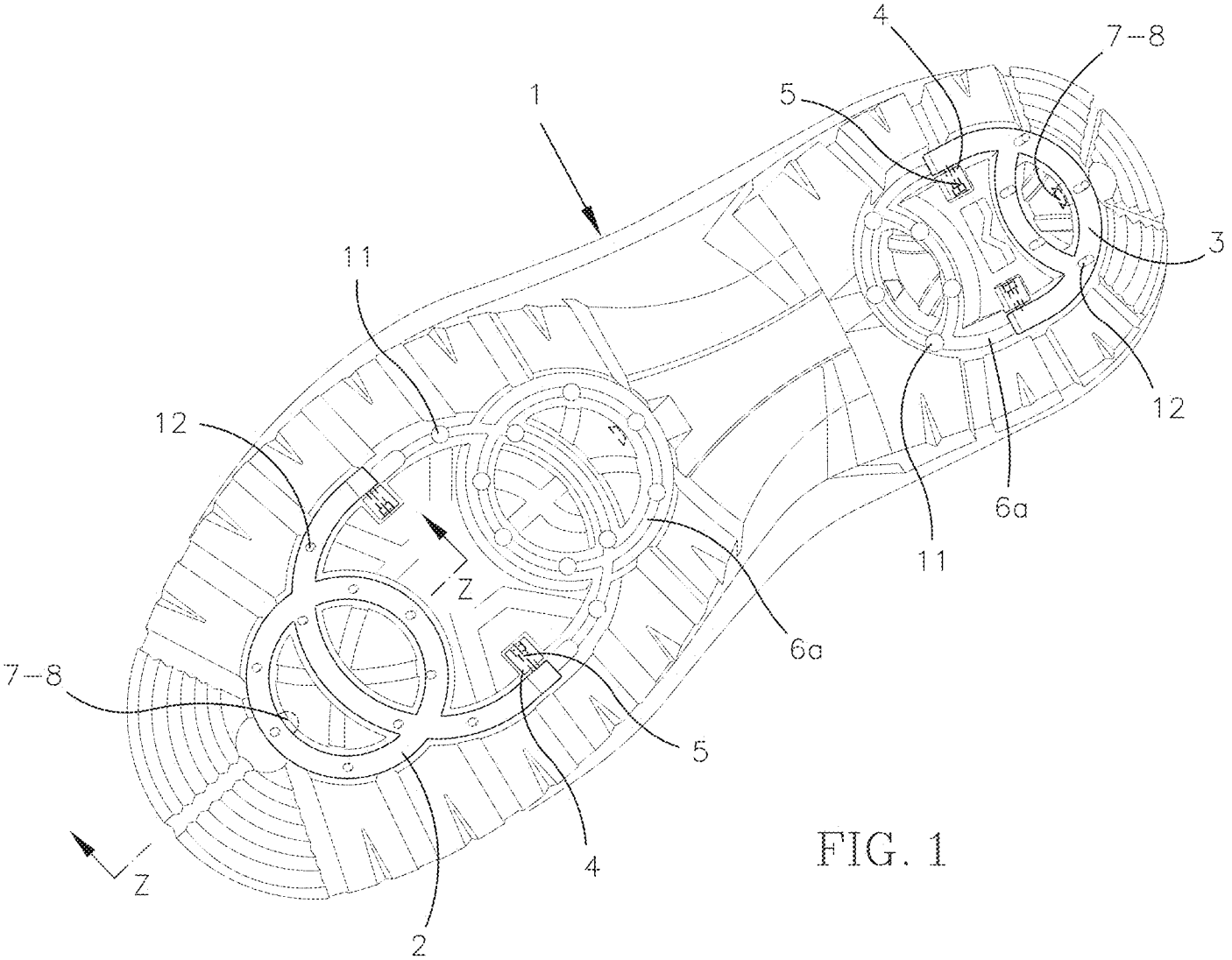
FIG. 1 shows a top view of the face of the sole intended to come into contact with the ground, the sole according to the invention being provided, where illustrated, by way of example, with two overturning spike holder elements or brackets in the shape of brackets arranged in the slots thereof with the spikes in operating position, i.e. facing outwards.

This is obtained by providing, on the moderately plugged face of FIG. 1, that intended to come into contact with the treading surface, both on the front part and on the rear area, at least one slot 6*a* capable of housing a rail or bracket which carries a certain number of nails or spikes 12 embedded due to molding, conveniently distributed and spaced apart. In the accompanying drawings, there are two brackets, indicated with reference numerals 2 and 3, respectively.

Such rails or brackets 2, 3 may be shaped in the most different ways: for example, like in the case illustrated, in the shape of a half-circle bracket 2 crossed with a circle having smaller diameter, or in the shape again of a half-circle bracket 3 crossed with another arc of circle having similar radius.

Figure 6:
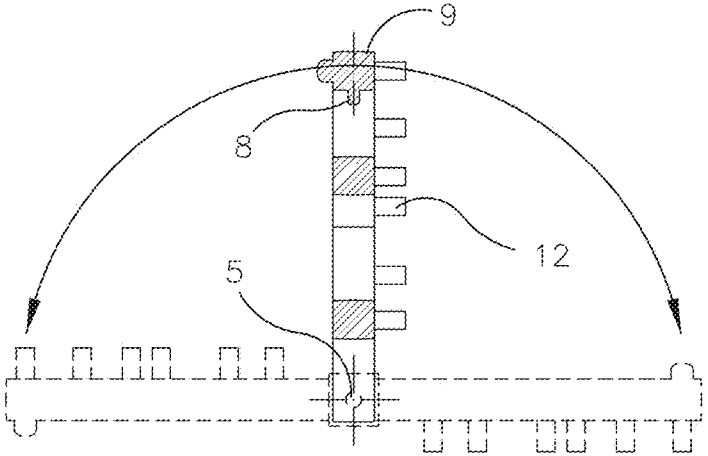
FIG. 6 diagrammatically shows, on a larger scale, the rotation of a spike holder bracket from a vertical position into the two overturned rest and operating positions, respectively.

Said brackets 2, 3 are provided (see FIG. 1, FIG. 6), at the ends thereof, with rotation pins 5 which are inserted into respective rotation seats. Said seats simply consist of cubic blocks 4 provided with a hinging hole arranged according to the overturning axis of the two brackets 2, 3.

FIGS. 8, 8*a* and 8*b* show in detail the features both of pin 5 and of the hinging hole 5*b*. Advantageously, as described above, both pin 5 and hole 5*b* have an oval geometry which forces the bracket to move to the extracted position of the nails or to the retracted position thereof. Moreover, as shown in particular in FIG. 8*c*, pin 5 has a tapered head 5*b* having increased diameter, which once inserted in the related seat 4*b* of the cubic block 4 having different diameter, allows the rotation thereof but avoids it from coming out, thus avoiding the possible loss of the bracket or of the overturning support rail.

Figure 2:
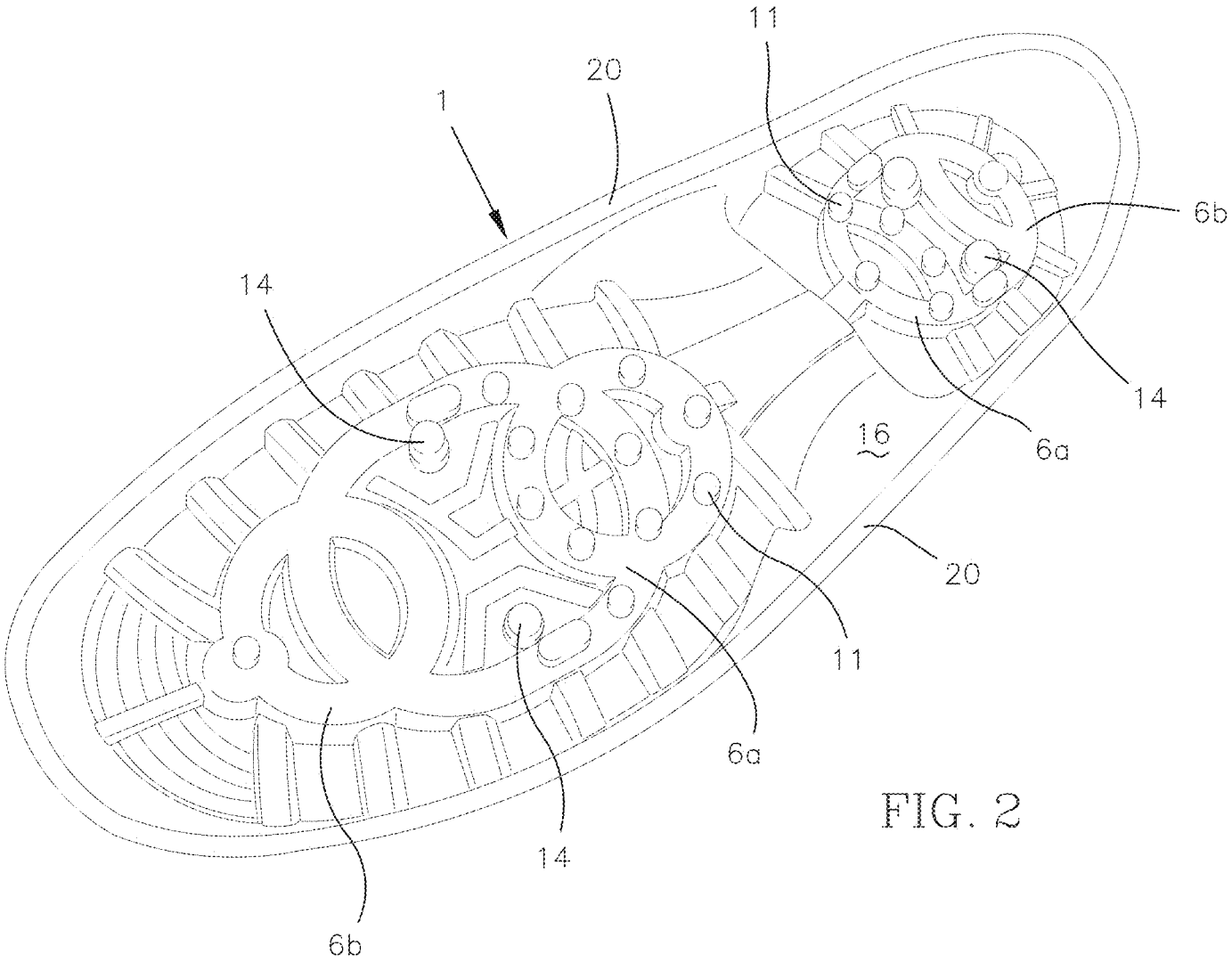
FIG. 2 again shows a top view on the same scale, of the sole of FIG. 1, shown from the inner side, with the housings of the spike holder elements and of the spikes themselves, obtained by molding on the other face of the sole.
Figure 4:
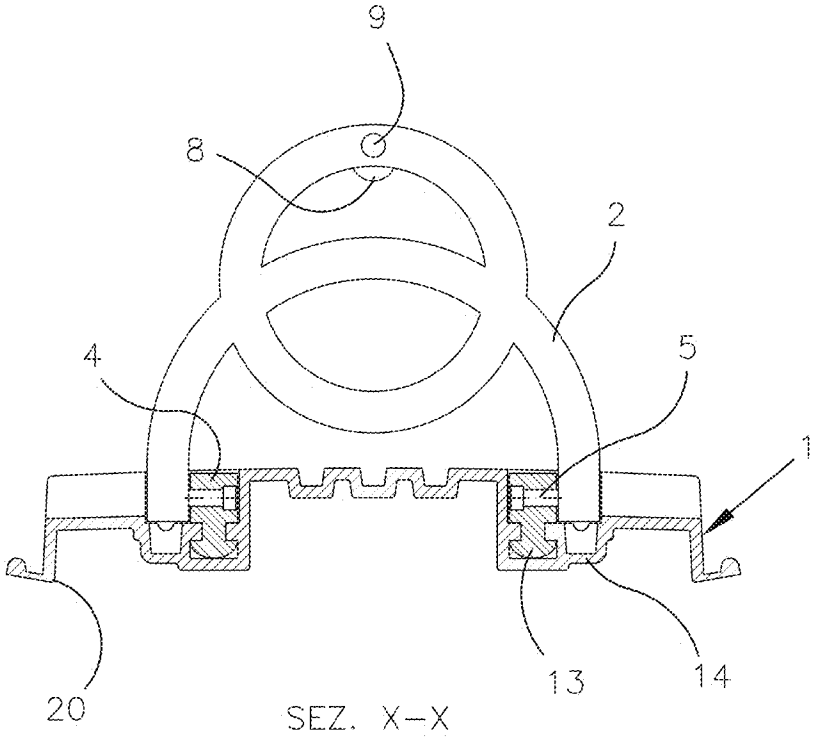
FIGS. 4 and 5 are two vertical sectional views according to the layout plan X-X and Y-Y of FIG. 3, which show the mushroom-shaped pins which vertically secure the blocks of hinges of the two spike holder brackets to the sole, both brackets being overturned by 90° with respect to the rest position of FIG. 3 to note the tooth and sphere, respectively, which ensure the stop thereof in the two overturned positions, and the anti-slipping spikes.
Figure 5:
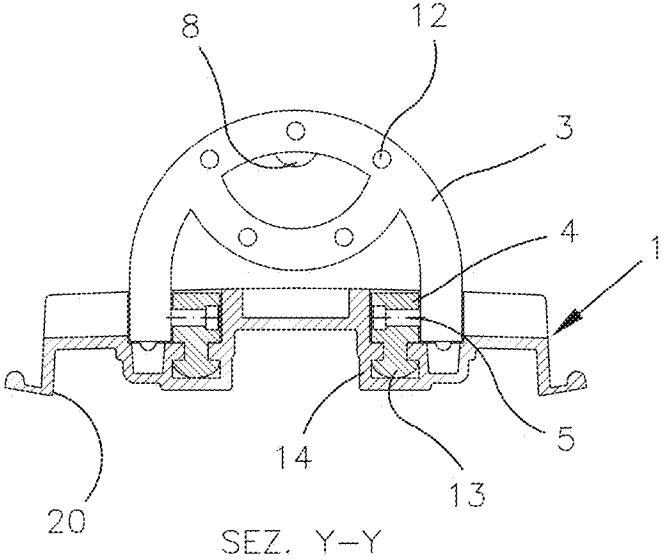

As illustrated in FIGS. 4 and 5, the cubic blocks 4 are rigidly secured to the sole by means of a mushroom-shaped pin 13 which serves to block in place such a cubic block and which, for this purpose, is inserted in a seat 14 which, originating from the outwards-facing face of the sole, extends vertically on the inner face of the sole itself, next to the respective slots 6, as illustrated in FIG. 2.

Figure 3:
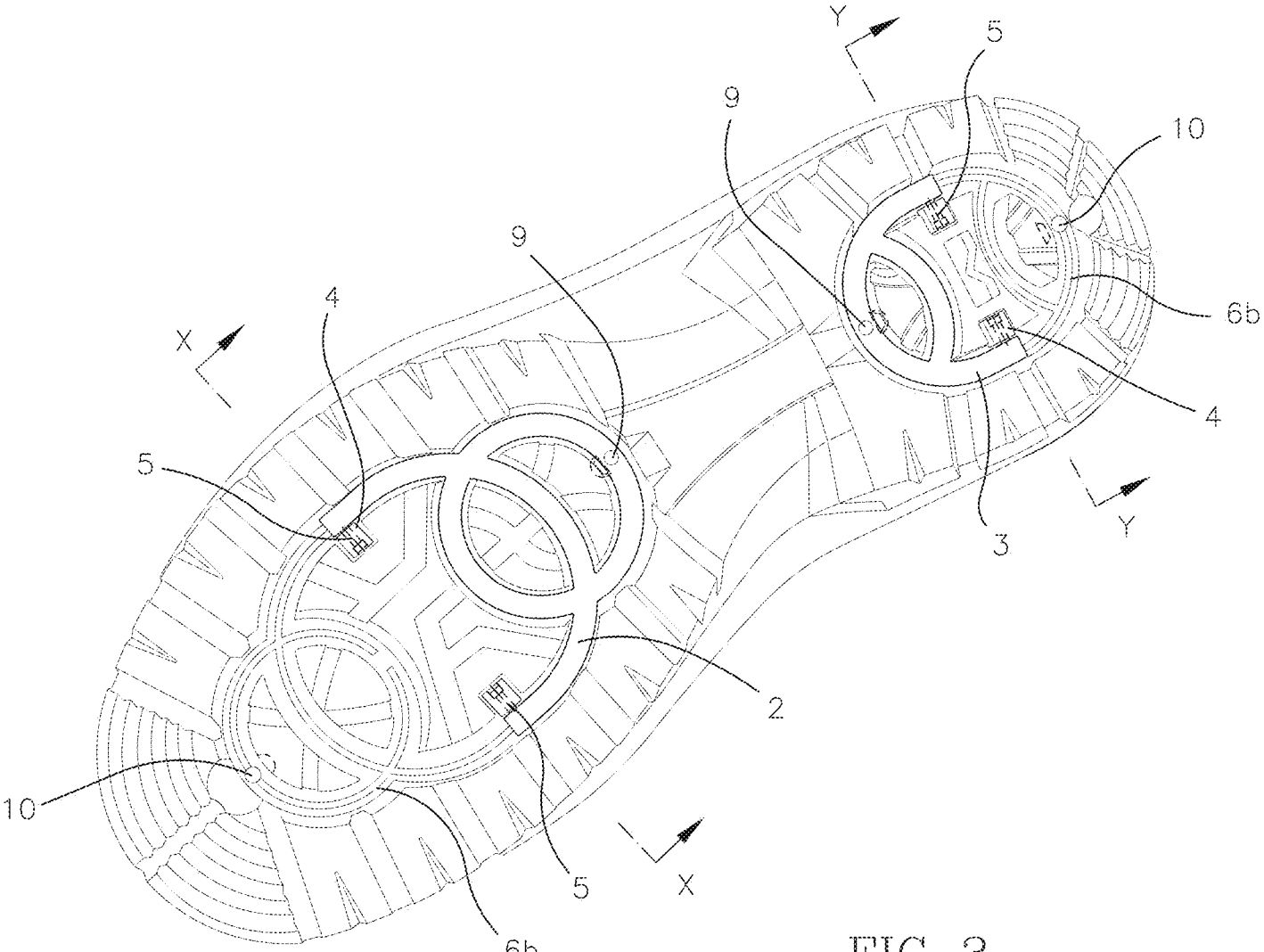
FIG. 3 shows the sole according to the invention, with two overturned spike holder brackets in the rest position, i.e. with the spikes facing the inside of the housing slots.

There are second corresponding slots 6*b* both in the front part of the sole and in the rear part, and arranged to mirror the first slots 6*a* which define the operating position, which second corresponding slots 6*b* differ from the first ones only because, as illustrated in FIG. 1, they have blind holes 11 on the bottom intended to receive the corresponding spikes 12 of the brackets 2 and 3 when they are overturned in the non-operating position of FIG. 3.

As is worth noting in FIG. 2, in the preferred embodiment illustrated, in order to lighten the sole, the tread plugs, the slots 6*a*, 6*b*, said holes 11, as well as the seats 14 of the mushroom-shaped pins 13, are not obtained in the thickness of the sole, rather are made in specific closed seats which protrude upwards in the shape of ribs, from the inner face of the sole, above bottom 16.

This allows a free volume to be left with respect to the upwards protruding side edges 20 of sole 1, which is sufficient to use all the modern technologies relating to the cushioning and control factors of the movement which may be introduced with the midsole to which the sole is glued.

Figure 7:
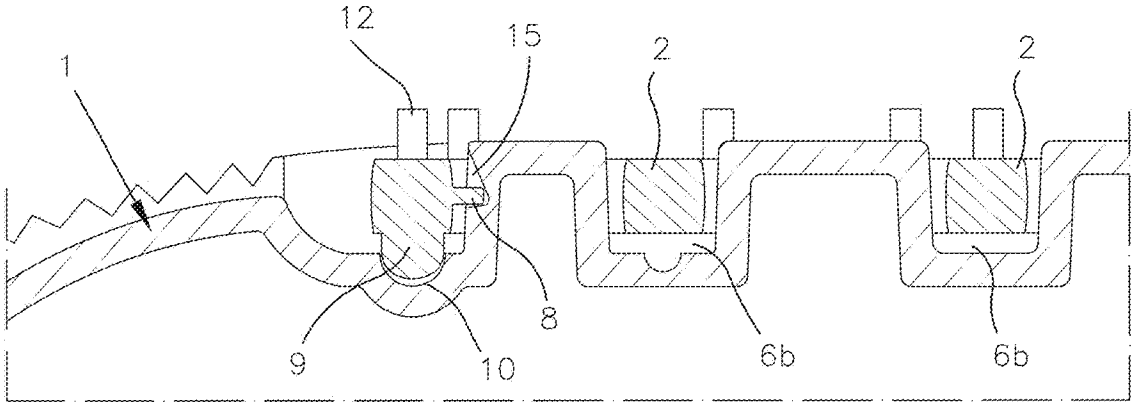
FIG. 7 is a sectional view according to the layout plan Z-Z of FIG. 1, and on a larger scale, which in particular shows the snap-fitting blocking tooth of a spike holder bracket when it is in the operating position thereof.

To ensure the brackets 2 and 3 are properly accommodated in the housing slots thereof, both in the rest position and after overturning, a system for blocking in place said brackets (illustrated in FIGS. 1, 6 and 7) is provided. As illustrated in such drawings, said brackets 2 and 3 indeed are both provided in distal position with respect to the overturning axis thereof, at the centerline thereof, on the face opposite to that where there are the spikes 12, with a vertical pin 9 which, when bracket 2 is in the anti-slipping operating position, is positioned in a corresponding cavity 10 obtained on the bottom of the slot 6*b* (FIGS. 3 and 7). Said pin 9 is blocked in place due to a tooth 8 which is snap-fitted in a seat 15 obtained by undercut on the inner vertical wall of slot 6*b* itself and configured so as to allow a proportional tightening to the bending exerted on the sole when walking.

Figures 9, 10:
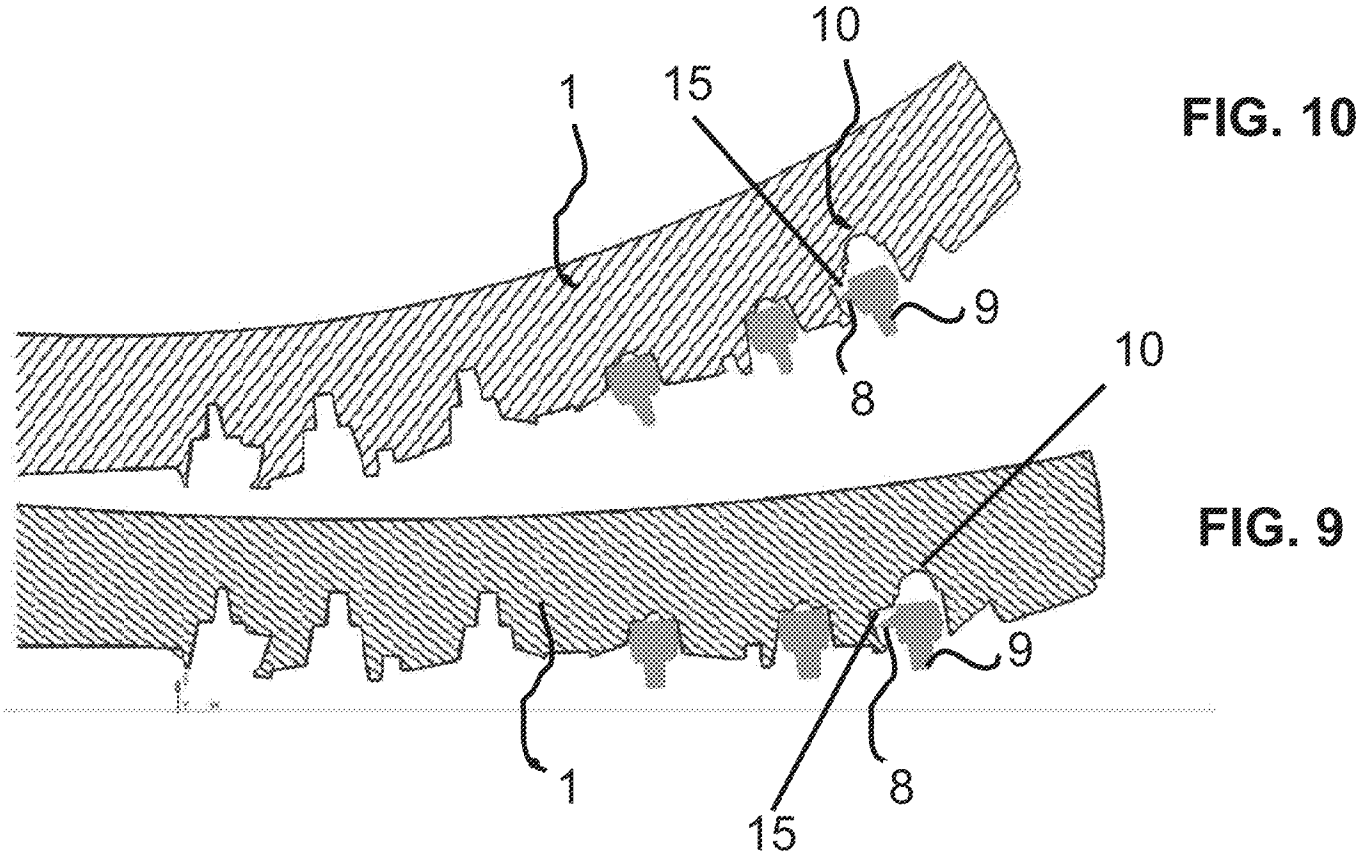
FIGS. 9 and 10 show sectional views of the sole with a tooth, carried by the spike holder element or bracket and positioned in the specific concave seat created by an undercut in the inner vertical wall of the slot of the sole in normal condition and in folded condition when walking, respectively, where the proportional tightening to the bending of the sole is noted.

Indeed, as illustrated in detail in FIGS. 9 and 10, seat 15 created by undercut has a concave geometry. Accordingly, tooth 8, which is inserted in a snap-fitting manner, is increasingly tightened during the bending due to such a shape because the thickness of the wall progressively increases in direction of the undercut.

Pin 9 itself also serves the purpose of ensuring the proper positioning of the bracket in the rest position because by protruding from the face of the bracket not provided with spikes, if the bracket is not completely retracted in its housing slot for any reason, said pin is intended to first come into contact with the ground and is capable of exerting a sufficient pressure to bring the bracket itself to the correct rest position without the need to manually intervene, with tooth 8 which is snap-fitted in the corresponding cavity 15 obtained on the inner vertical wall of slot 6*a*.

A preferred embodiment of the invention has been described hereto. Moreover, it is apparent that several changes and variations may be made by those skilled in the art without however departing from the scope of the invention, as defined by the following claims.

The invention claimed is:

1. A shoe sole comprising:

rigid or semi-rigid support elements;

slots defined in the sole;

an anti-slipping device in which anti-slipping or anti-sliding devices are provided, the anti-slipping or anti-sliding devices not being directly secured to the shoe sole, the anti-slipping or anti-sliding devices being but arc secured on the rigid or semi-rigid support elements configured to be overturned to be hidden in the slots, overturning of the support elements of the anti-sliding devices occurring about horizontal axes such that the support elements are parallel to a resting plane of the sole, by snap-fitted pins within respective rotation seats including cubic blocks each laterally provided with a corresponding hinging hole, each of the cubic blocks being secured to the sole by one of the snap-fitted pins; and at least one mushroom-shaped coupling element formed as one piece with a respective cubic block, the coupling element being configured to anchor a respective one of the cubic blocks forming the respective rotation seat of the overturning support element to the sole, the coupling element being removably snap-fitted in a corresponding accommodation seat arranged by molding in the sole next to the respective slot where the overturning support element is accommodated after the overturning, without interfering with the integrity of the sole itself, thus avoiding a simple torsion of a bottom of the sole from causing detachment and loss thereof, the cubic blocks forming the respective rotation seat of the overturning support element and the mushroom-shaped coupling element configured to position the overturning support element in place on the sole are made of a material having the same elastic modulus as the overturning support elements, but less elastic modulus than the elastic modulus of a material of the sole, the overturning support elements and the cubic blocks forming the rotation seats are configured to be replaced by maneuvers by a user without requiring particular tools due to elasticity of the couplings, wherein both the snap-fitted pin of the respective overturning support element of the anti-slipping or anti-sliding devices and the related seat in the cubic block acting as a pivot for rotation thereof, have oval geometry which forces switching from an extracted position of the slipping or anti-sliding devices to a retracted position thereof, or vice versa, without stable intermediate positions, thus ensuring that the support elements are securely located in one or another of an operating position and a rest position.

2. The shoe sole according to claim 1, wherein each of the support elements is provided with a protrusion of sphere-like pin, in distal position with respect to the overturning axis thereof, on a face opposite to the anti-slipping or anti-sliding devices to ensure that the support elements of the spikes completely return to the rest position, the protrusion or sphere like pin being configured to be positioned in a corresponding cavity defined in a bottom of the respective slot, the protrusion of sphere-like pin being configured, during improper use including when the overturning support elements of anti-slipping or anti-sliding devices do not retract accurately to the rest position in the slots, to exert a pressure on the overturning support elements themselves sufficient to sink overturning support elements properly into the corresponding slot at simple contact with the ground.

3. The shoe sole according to claim 2, wherein each of the overturning support elements is further provided with a tooth that blocks the protrusion or sphere-like pin in place by snap-fitting in a specific concave seat created by an undercut on the inner vertical wall of both mirror-like slots where the protrusion or sphere-like pin is accommodated, in the rest and operating positions in order to safely block in place the overturning support element in the rest and operating positions thus allowing tightening which is directly proportional to bending exerted on the sole.

4. The shoe sole according to claim 1, wherein the snap-fitted pin has a tapered head having increased diameter, the snap-fitted pin being configured to allow rotation thereof and prevent an accidental release thereof, thus avoiding a possible loss of the overturning support element when the snap-fitted pin is inserted in the respective seat of the cubic block.

5. The shoe sole according to claim 4, wherein the sphere-like pin does not touch the ground when the overturning support elements of the anti-slipping or anti-sliding devices are perfectly retracted in the slots in the rest position as the sphere-like pin is in a raised position with respect to the ground due to grip treads obtained on the face of the sole in contact with the ground, and thus does not interfere with resting stability of the sole.

6. The shoe sole according to claim 1, wherein specific tapered ones of the slots that facilitate a change of position only with intervention of fingers of a user are provided between grip treads of the sole in order to overturn the overturning support elements of the anti-slipping or anti-sliding devices from the rest position to the operating position.

7. The shoe sole according to claim 1, wherein grip treads, the slots, the holes, and the accommodation seats of the mushroom-shaped coupling elements are not disposed in a thickness of the sole, the grip treads, the slots, and the holes being disposed in specific closed rib-shaped seats which protrude upwards, from an inner face of the sole, above the bottom to leave a free volume with respect to upwards protruding side edges of the sole sufficient to use cushioning and control factors of movement introduced with a midsole to which the sole is configured to be glued.

8. The shoe sole according to claim 2, wherein the snap-fitted pin has a tapered head having increased diameter, once the snap-fitted pin is inserted in the related seat of the cubic block, the snap-fitted pin is configured to allow rotation thereof but to prevent accidental release thereof, thus avoiding a possible loss of the overturning support element.

9. The shoe sole according to claim 3, wherein the snap-fitted pin has a tapered head having increased diameter, once the snap-fitted pin is inserted in the related seat of the cubic block, the snap-fitted pin is configured to allow rotation thereof but to prevent accidental release thereof, thus avoiding a possible loss of the overturning support element.

10. The shoe sole according to claim 2, wherein specific tapered ones of the slots that facilitate a change of position only with intervention of fingers of a user are provided between grip treads of the sole in order to overturn the overturning support elements of the anti-slipping or anti-sliding devices from the rest position to the operating position.

11. The shoe sole according to claim 3, wherein specific tapered ones of the slots that facilitate a change of position only with intervention of fingers of a user are provided between grip treads of the sole in order to overturn the overturning support elements of the anti-slipping or anti-sliding devices from the rest position to the operating position.

12. The shoe sole according to claim 4, wherein specific tapered ones of the slots that facilitate a change of position only with intervention of the fingers of a user are provided between grip treads of the sole in order to overturn the overturning support elements of the anti-slipping or anti-sliding devices from the rest position to the operating position.

13. The shoe sole according to claim 5, wherein specific tapered ones of the slots that facilitate a change of position only with intervention of fingers of a user are provided between grip treads of the sole in order to overturn the overturning support elements of the anti-slipping or anti-sliding devices from the rest position to the operating position.

14. The shoe sole according to claim 8, wherein specific tapered ones of the slots that facilitate a change of position only with intervention of fingers of a user are provided between grip treads of the sole in order to overturn the overturning support elements of the anti-slipping or anti-sliding devices from the rest position to the operating position.

15. The shoe sole according to claim 9, wherein specific tapered ones of the slots that facilitate a change of position only with intervention of fingers of a user are provided between grip treads of the sole in order to overturn the overturning support elements of the anti-slipping or anti-sliding devices from the rest position to the operating position.

16. The shoe sole according to claim 2, wherein grip treads, the slots, the holes, and the accommodation seats of the mushroom-shaped coupling elements are not disposed in a thickness of the sole, the grip treads, the slots, and the holes being disposed in specific closed rib-shaped seats which protrude upwards, from an inner face of the sole, above the bottom to leave a free volume with respect to upwards protruding side edges of the sole sufficient to use cushioning and control factors of movement introduced with a midsole to which the sole is configured to be glued.

17. The shoe sole provided according to claim 3, wherein grip treads, the slots, the holes, and the accommodation seats of the mushroom-shaped coupling elements are not disposed in a thickness of the sole, the grip treads, the slots, and the holes being disposed in specific closed rib-shaped seats which protrude upwards, from an inner face of the sole, above the bottom to leave a free volume with respect to upwards protruding side edges of the sole sufficient to use cushioning and control factors of movement introduced with a midsole to which the sole is configured to be glued.

18. The shoe sole according to claim 4, wherein grip treads, the slots, the holes, and the accommodation seats of the mushroom-shaped coupling elements pins are not disposed in a thickness of the sole, the grip treads, the slots, and the holes being disposed in specific closed rib-shaped seats which protrude upwards, from an inner face of the sole, above the bottom to leave a free volume with respect to upwards protruding side edges of the sole sufficient to use cushioning and control factors of movement introduced with a midsole to which the sole is configured to be glued.

19. The shoe sole according to claim 5, wherein grip treads, the slots, the holes, and the accommodation seats of the mushroom-shaped coupling elements are not disposed in a thickness of the sole, the grip treads, the slots, and the holes being disposed in specific closed rib-shaped seats which protrude upwards, from an inner face of the sole, above the bottom to leave a free volume with respect to upwards protruding side edges of the sole sufficient to use cushioning and control factors of movement introduced with a midsole to which the sole is configured to be glued.

20. The shoe sole according to claim 6, wherein grip treads, the slots, the holes, and the accommodation seats of the mushroom-shaped coupling elements are not disposed in a thickness of the sole, the grip treads, the slots, and the holes being disposed in specific closed rib-shaped seats which protrude upwards, from an inner face of the sole, above the bottom to leave a free volume with respect to upwards protruding side edges of the sole sufficient to use cushioning and control factors of movement introduced with a midsole to which the sole is configured to be glued.

21. The shoe sole according to claim 1, wherein the anti-slipping or anti-sliding devices are nails or spikes.

* * * * *